US010473348B2

(12) United States Patent
Price et al.

(10) Patent No.: US 10,473,348 B2
(45) **Date of Patent: *Nov. 12, 2019**

(54) METHOD AND SYSTEM FOR ELIMINATING AIR STRATIFICATION VIA DUCTLESS DEVICES

(71) Applicant: Internal Air Flow Dynamics, LLC, Amelia Island, FL (US)

(72) Inventors: Roy H. Price, Amelia Island, FL (US); Albert E. Fiorini, Naples, FL (US); Mark A. Price, Alpharetta, GA (US)

(73) Assignee: INTERNAL AIR FLOW DYNAMICS, LLC, Amelia Island, FL (US)

( * ) Notice: Subject to any disclaimer, the term of this patent is extended or adjusted under 35 U.S.C. 154(b) by 704 days.

This patent is subject to a terminal disclaimer.

(21) Appl. No.: 14/934,778

(22) Filed: Nov. 6, 2015

(65) Prior Publication Data

US 2016/0131380 A1 May 12, 2016

Related U.S. Application Data

(60) Provisional application No. 62/077,588, filed on Nov. 10, 2014.

(51) Int. Cl.
*F24F 11/30* (2018.01)
*F24F 11/70* (2018.01)
(Continued)

(52) U.S. Cl.
CPC ..... *F24F 11/30* (2018.01); *F24F 11/70* (2018.01); *F24F 11/89* (2018.01); *F24F 1/01* (2013.01);
(Continued)

(58) Field of Classification Search
CPC ..... F24F 11/001; F24F 13/04; F24F 1/0284; F24F 1/0043; F24F 1/0047; F24F 1/02;
(Continued)

(56) References Cited

U.S. PATENT DOCUMENTS 1,874,043 A * 8/1932 Ilg ..... F28D 1/024 454/259
2,301,045 A * 11/1942 Heath ..... F28D 1/024 165/125
(Continued)

FOREIGN PATENT DOCUMENTS

CN 105008812 A * 10/2015
DE 10053026 A1 * 7/2001 ..... F24F 1/01
(Continued)

OTHER PUBLICATIONS

ASHRAE Standard; Addendum to Standard 62-2001: Ventilation Acceptable Indoor Air Quality The American society of Heating REfrigerating and Air Conditioning Engineers, Inc; 2003.*
(Continued)

*Primary Examiner* — Gregory L Huson
*Assistant Examiner* — Frances F. Hamilton
(74) *Attorney, Agent, or Firm* — NEO IP

(57) ABSTRACT

A system and method for creating substantially continuous circulation within a volume to be managed comprising at least two ductless devices including three exit zones, and a method for designing a system for increasing internal air turns in a volume of air to be managed within a facility, comprising determining locations of existing heating, ventilation, and air conditioning (HVAC) system components, determining preferred locations of the at least two ductless devices, and continuously moving air through the at least two ductless devices.

20 Claims, 8 Drawing Sheets
(5 of 8 Drawing Sheet(s) Filed in Color)

(51) Int. Cl.

| | |
|---|---|
| ***F24F 11/89*** | (2018.01) |
| *F24F 1/01* | (2011.01) |
| *F24F 11/00* | (2018.01) |
| *F24F 110/00* | (2018.01) |

(52) U.S. Cl.
CPC ..... *F24F 11/0001* (2013.01); *F24F 2110/00* (2018.01)

(58) Field of Classification Search
CPC ..... F24F 1/03; F24F 1/0014; F24F 1/0317; F24F 7/007; F24F 13/06; F24F 2221/14; F04D 29/4246; F04D 29/4253
See application file for complete search history.

(56) References Cited

U.S. PATENT DOCUMENTS 3,180,245 A * 4/1965 Erickson, Jr. ..... F24F 13/04 165/109.1
3,610,522 A * 10/1971 Tutt ..... F24F 11/047 236/13
3,827,342 A * 8/1974 Hughes ..... F24F 7/065 422/4
3,937,133 A * 2/1976 Bertin ..... F24F 13/075 454/320
4,103,146 A * 7/1978 Rampe ..... F24F 7/00 165/122
4,191,543 A * 3/1980 Peters ..... A61L 9/00 422/122
4,512,242 A * 4/1985 Bohanon, Sr. ..... F24F 7/065 454/230
4,522,255 A * 6/1985 Baker ..... F24F 1/0047 165/48.1
4,535,932 A * 8/1985 Herb ..... F24F 13/072 137/468
4,730,551 A * 3/1988 Peludat ..... F24F 3/1603 454/233
4,960,041 A * 10/1990 Kiser ..... F24H 3/0488 454/238
5,042,366 A * 8/1991 Panetski ..... F24F 7/065 454/231
5,078,574 A * 1/1992 Olsen ..... F04D 19/002 415/182.1
5,127,878 A * 7/1992 Meckler ..... F24F 1/01 454/264
5,263,897 A * 11/1993 Kondo ..... F24C 15/2028 454/189
5,288,267 A * 2/1994 Mitchell ..... F24F 13/0604 454/230
5,538,074 A * 7/1996 Meyer ..... F04D 25/14 137/846
5,577,958 A * 11/1996 Kumekawa ..... F15D 1/04 454/233
5,624,311 A * 4/1997 Peludat ..... A61L 9/122 261/DIG. 88
5,938,527 A * 8/1999 Oshima ..... F24F 1/01 454/344
6,168,517 B1 * 1/2001 Cook ..... F24F 7/007 454/269
6,463,397 B1 * 10/2002 Cohen ..... A01K 1/031 454/238
6,595,848 B1 * 7/2003 Robinson ..... F24F 13/04 454/261
6,623,353 B1 * 9/2003 Akhtar ..... F24F 1/01 454/233
6,629,886 B1 * 10/2003 Estepp ..... F24F 11/745 454/229
6,662,144 B1 * 12/2003 Normann ..... G06F 17/5004 703/1
6,685,556 B1 * 2/2004 Bertin ..... F24F 13/075 454/256
6,718,277 B2 * 4/2004 Sharma ..... F24F 11/62 702/132
6,955,596 B1 * 10/2005 Walker ..... F24F 7/007 454/230
6,965,848 B2 * 11/2005 Ballus ..... G06F 17/5004 454/231
7,467,931 B2 * 12/2008 O'Toole ..... F04D 25/088 415/220
8,147,193 B2 * 4/2012 Weaver ..... F04D 25/12 415/213.1
8,336,672 B2 * 12/2012 Derks ..... F16L 55/033 181/224
8,874,497 B2 * 10/2014 Raestik ..... G05B 19/042 706/21
8,974,565 B2 * 3/2015 Cecchi ..... B01D 46/42 55/350.1
9,022,731 B2 * 5/2015 Seccareccia ..... F04D 17/16 415/126
9,091,454 B2 * 7/2015 Dempsey ..... F24F 11/74
9,151,295 B2 * 10/2015 Avedon ..... F04D 25/08
9,170,574 B2 * 10/2015 Fuller ..... G05B 15/02
9,188,508 B1 * 11/2015 Meyer ..... G01M 99/005
9,222,688 B2 * 12/2015 Ishizaka ..... F24F 3/065
9,335,061 B2 * 5/2016 Avedon ..... F24F 7/065
9,702,576 B2 * 7/2017 Avedon ..... F24F 7/007
9,714,663 B1 * 7/2017 Avedon ..... F04D 25/088
9,804,611 B2 * 10/2017 Dean-Hendricks ..... G05D 23/1902
2004/0237572 A1 * 12/2004 Lee ..... F24F 1/0007 62/419
2005/0277381 A1 * 12/2005 Banerjee ..... F24F 11/77 454/229
2005/0287945 A1 * 12/2005 Choi ..... F24F 7/08 454/234
2006/0254304 A1 * 11/2006 Nacenta Anmella ..... F24F 1/0007 62/419
2008/0022705 A1 * 1/2008 Clearman ..... F24F 3/1405 62/173
2008/0178615 A1 * 7/2008 Yoon ..... F24F 3/06 62/79
2010/0047115 A1 * 2/2010 Krichtafovitch ..... A61L 9/16 422/4
2010/0202932 A1 * 8/2010 Danville ..... A61L 9/205 422/121
2010/0291858 A1 * 11/2010 Toy ..... F04D 25/088 454/258
2011/0077779 A1 * 3/2011 Fuller ..... G05B 15/02 700/276
2011/0151766 A1 * 6/2011 Sherman ..... F24F 7/007 454/239
2012/0052786 A1 * 3/2012 Clawsey ..... F24F 7/065 454/229
2012/0239324 A1 * 9/2012 Ueda ..... F24F 11/30 702/62
2013/0023198 A1 * 1/2013 Badenhorst ..... F24F 13/06 454/269
2013/0030575 A1 * 1/2013 Dempsey ..... F24F 11/74 700/276
2013/0052935 A1 * 2/2013 Priest ..... A01K 1/0047 454/338
2014/0109610 A1 * 4/2014 Wulf ..... F24F 1/00 62/314
2014/0120819 A1 * 5/2014 Stakutis ..... F24F 3/1607 454/56
2014/0202336 A1 * 7/2014 Benton ..... F24F 11/0001 96/224
2014/0303789 A1 * 10/2014 Wroblewski ..... F24F 11/30 700/276
2014/0371936 A1 * 12/2014 Kamel ..... G01R 21/1333 700/291

(56) References Cited

U.S. PATENT DOCUMENTS

| | | | | |
|---|---|---|---|---|
| 2015/0004898 | A1* | 1/2015 | Desrochers | G01N 33/0054 454/239 |
| 2016/0161134 | A1* | 6/2016 | Choo | F04D 17/16 454/235 |
| 2016/0187911 | A1* | 6/2016 | Carty | G05B 15/02 700/276 |

FOREIGN PATENT DOCUMENTS

| | | | | |
|---|---|---|---|---|
| DE | 102013112278 | A1 * | 5/2014 | |
| EP | 0167729 | A1 * | 1/1986 | F24F 7/007 |
| GB | 2304888 | B * | 2/1999 | F24F 13/26 |
| GB | 2499582- | * | 11/2018 | F24F 7/007 |
| JP | 2005227888 | A * | 8/2005 | |
| JP | 2007174904 | A * | 7/2007 | |
| JP | 2013020510 | A * | 1/2013 | |
| KR | 20040019866 | A * | 3/2004 | |

OTHER PUBLICATIONS

Ever-Air Tech Solution, http://www.everairtech.com/solution.html, web page printed Nov. 2015; 4 pages.

* cited by examiner

METHOD AND SYSTEM FOR ELIMINATING AIR STRATIFICATION VIA DUCTLESS DEVICES

CROSS REFERENCE TO RELATED APPLICATIONS

The present application claims the benefit of U.S. Provisional Patent Application No. 62/077,588, filed Nov. 10, 2014, which is hereby incorporated by reference in its entirety.

BACKGROUND OF THE INVENTION

1. Field of the Invention

The present invention relates generally to methods for managing air uniformity and/or dynamic air flow within an enclosed space, and more particularly, methods for designing and providing a system for eliminating air pockets, eliminating air stratification, minimizing inconsistent temperature, and increasing internal air turns within a facility.

2. Description of the Prior Art

Systems, methods, and devices for air distribution and circulation management within facilities are well-known in the prior art. In particular, HVAC systems and area fans are well-known in the prior art for distributing and circulating air within facilities. Conventional HVAC systems introduce hot, cool, or ventilation air into a facility—typically through a costly system of ductwork or via ductwork to a diffuser box. Significant temperature fluctuations are caused by walk and loading, doors, windows, hot or cold walls, hot or cold roof, the number of occupants, and equipment inside of a facility. Due to intermittent run time and duct and diffuser box air distribution systems, conventional systems tend to create air stratification and hot zones. In effect, these systems are relying on the system fans, with large hp motors, to generate intermittent air circulation. Until the HVAC system restarts, still air develops into pockets of different temperatures. This change in temperature, in addition to hot and cold spots, creates bands of warm and cool air throughout a facility, known as air (or temperature) stratification. A traditional HVAC system runs when the air differential (or temperature) varies from the set temperature at the thermostat location and turns off when the temperature reaches what is called for on the thermostat. By design, a traditional HVAC system is never at the exact 'right' temperature, but works to stay within a range of expected temperatures. It would also be economically intolerant to deploy RTU's with blowers in an attempt to de-stratify a facility. Due to limited air throw, area fans also do not effectively eliminate air pockets or thermal stratification in a facility, nor are they economically capable of minimizing temperature fluctuations in a facility. Accordingly, a need exists for economically sound and energy efficient methods, systems, and devices which sufficiently reduce or eliminate air pockets, thermal stratification, and temperature fluctuations. These methods, systems, and devices should be cost-effective, and allow for a consistent temperature (within 2 degrees Fahrenheit of the desired temperature) to be maintained.

One example of a prior art solution to the above-stated problems can be found at: http://www.everairtech.com/solution.html. This solution shows a unit with a single fan encased in a rectangular housing. Each unit requires a short supply and a return duct from a package or split system HVAC unit.

Other relevant art includes the following US Patent documents:

US Patent Application Pub. No. 2010/0202932 for "Air movement system and air cleaning system" by Danville, filed Feb. 10, 2010 and published Aug. 12, 2010, describes an air movement and air cleaning system which includes an air movement system preferably including fan and fan housing to prevent thermal gradients in a building or room, in combination with an air cleaning surface of at least titanium dioxide, to react with moisture in the air and an ultraviolet light source in close proximity to the air cleaning surface, such that as humidity in the air passes through the air movement system over the titanium dioxide, the ultraviolet light creates hydroxyl radicals in the presence of the titanium oxide catalytic surface thereby purifying the air that passes there through.

US Pub. No. 2010/0291858 for "Automatic control system for ceiling based on temperature differentials" by Toy, filed Jul. 28, 2010 and published Nov. 18, 2010, describes a fan which includes a hub, several fan blades, and a motor that is operable to drive the hub. A motor controller is in communication with the motor, and is configured to select the rate of rotation at which the motor drives the hub. The fan is installed in a place having a floor and a ceiling. An upper temperature sensor is positioned near the ceiling. A lower temperature sensor is positioned near the floor. The temperature sensors communicate with the motor controller, which includes a processor configured to compare substantially contemporaneous temperature readings from the upper and lower temperature sensors. The motor controller is thus configured to automatically control the fan motor to minimize the differences between substantially contemporaneous temperature readings from the upper and lower temperature sensors. The fan system may thus substantially destratify air in an environment, to provide a substantially uniform temperature distribution within the environment.

U.S. Pat. No. 6,955,596 for "Air flow producer for reducing room temperature gradients" by Walker, et al., filed on Aug. 26, 2004 and issued on Oct. 18, 2005, describes an air flow producer mounted at the ceiling of a room generates an air flow toward the floor, reducing temperature gradients and improving heating and cooling efficiency. A housing defines a circular cylindrical, vertical flow passage that receives the air flow. A discharge chamber discharges the air flow through a grill toward the floor. The discharge chamber has a cross-section that expands progressively from the outlet of the flow passage to the outlet of the discharge chamber. The air flow through the housing is produced by a fan with a rotary blade assembly, and the blade assembly extends partially into the discharge chamber. The position of the blade assembly and the expanding cross-section of the discharge chamber cooperate to increase air flows through the housing. Optionally, an air intake chamber of generally inverted frustoconical shape may be mounted at the upper inlet end of the cylindrical flow passage to smooth flows further.

SUMMARY OF THE INVENTION

The present invention provides a method for providing a system, a method for designing a system, and a system for eliminating air stratification, eliminating air pockets, minimizing inconsistent temperature, and increasing internal air turns within a facility. The methods and system of the present invention also reduce conventionally designed (ex: based on standard ASRAE formulas) tonnage and/or BTUs on HVAC systems.

One aspect of the present invention involves a method for providing a system, a method for designing or specifying requirements for a system, and a system for eliminating air stratification, eliminating air pockets, minimizing inconsistent temperature, and increasing internal air turns within a facility. The method includes continuously drawing air into at least one of one or more devices, continuously processing air in at least one of the one or more devices, and continuously pushing air through at least three exit zones in at least one of the one or more devices. The method for designing the system includes determining the approximate volume of the facility, determining the location of HVAC system components within the facility, and based on the approximate volume and location of the HVAC system components, determining the number and type of the one or more devices to install in the facility and at least one preferred location for the one or more devices within the facility. The system includes one or more devices that are neither HVAC-based nor duct-based operable to continuously draw air into at least one of the one or more devices, continuously process the air that is drawn into the at least one of the one or more devices, and continuously push air through at least three exit zones of the at least one of the one or more devices.

These and other aspects of the present invention will become apparent to those skilled in the art after a reading of the following description of the preferred embodiment when considered with the drawings, as they support the claimed invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
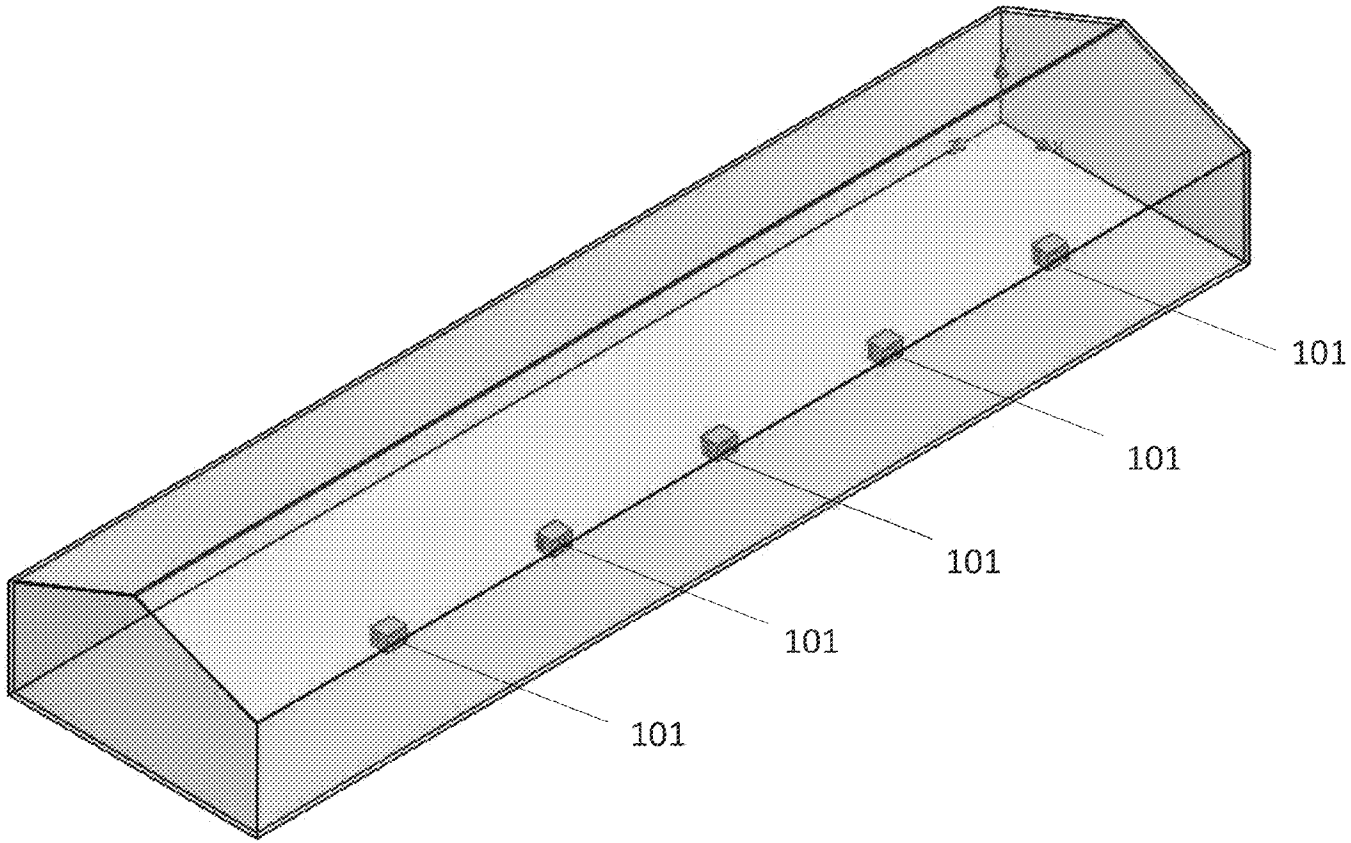
FIG. 1 is a perspective view of one embodiment of the present invention, illustrating a system for creating substantially continuous circulation within a volume to be managed. The system includes one or more devices 101 that are operable for continuously drawing in, processing, and pushing out air through at least three exits.

None of the prior art addresses the longstanding need for eliminating air pockets, eliminating air stratification, minimizing inconsistent temperature, and increasing internal air turns in an open ceiling environment independent of traditional HVAC systems and system components, such as ducts, with an objective of reducing HVAC tonnage. Thus, there remains a need for methods, systems, and devices which provide energy efficient air circulation to remove stratified air columns and air pockets, and maintain a stable and consistent temperature, namely within 2 degrees Fahrenheit of the desired temperature.

The present invention provides a method and system for eliminating air stratification, eliminating air pockets, minimizing inconsistent temperature and increasing internal air turns within a facility. In another embodiment, the present invention provides a method and system for minimizing air stratification, minimizing air pockets, and minimizing temperature fluctuations within a facility. In another embodiment, the present invention provides a method and system for eliminating air stratification, eliminating air pockets, and minimizing temperature fluctuations within a device throw area or range. In another embodiment, the present invention provides a method and system for minimizing air stratification, minimizing air pockets, and minimizing temperature fluctuations within the device throw area or range.

While the present invention is effective at eliminating air pockets, eliminating air stratification, minimizing inconsistent temperature, and increasing internal air turns in many facilities, it is particularly effective at doing so in open ceiling facilities and facilities with drop ceilings with clearances of 20 or more feet. Air turns refers to the number of times air completely rotates or turns over within a facility. Facilities where a consistent temperature is desired or necessary, such as industrial buildings, retail operations, food storage facilities, and pharmaceutical storage facilities, and distribution centers will benefit greatly from the present invention.

One aspect of the present invention involves a method for eliminating air stratification, eliminating air pockets, minimizing inconsistent temperature, and increasing internal air turns within a facility. The method includes continuously drawing air into at least one of one or more devices, continuously processing air in the at least one of the one or more devices, and continuously pushing air through at least three exit zones in the at least one of the one or more devices. In one embodiment of the present invention, a building is destratified by completing about 3-5 air turns. Once this destratification is substantially established or completely established, methods and systems of the present invention are utilized to maintain the destratification of the building. Notably, the present invention provides for estimating projected reduced tonnage and cost savings based on historical data for buildings using traditional HVAC systems compared to those buildings using systems and methods of the present invention. The present invention also provides for using historical weather and projected weather data for estimating projected reduced tonnage and cost savings based on historical data for buildings using traditional HVAC systems compared to those buildings using systems and methods of the present invention.

Another aspect of the present invention involves a method for designing a system for eliminating air stratification, eliminating air pockets, minimizing inconsistent temperature, and increasing internal air turns within a facility.

Another aspect of the present invention involves a system for eliminating air stratification, eliminating air pockets, minimizing inconsistent temperature, and increasing internal air turns within a facility. The system includes one or more devices that are neither HVAC-based nor duct-based operable to continuously draw air into at least one of the one or more devices, continuously process the air that is drawn into the at least one of the one or more devices, and continuously push air through at least three exit zones of the one or more devices.

Referring now to the drawings in general, the illustrations are for the purpose of describing a preferred embodiment of the invention and are not intended to limit the invention thereto.

FIG. 1 is a perspective view of one embodiment of the present invention, illustrating a system for creating substantially continuous circulation within a volume to be managed. The system includes one or more devices that are operable for continuously drawing in, processing, and pushing out air through at least three exits.

Figure 2:
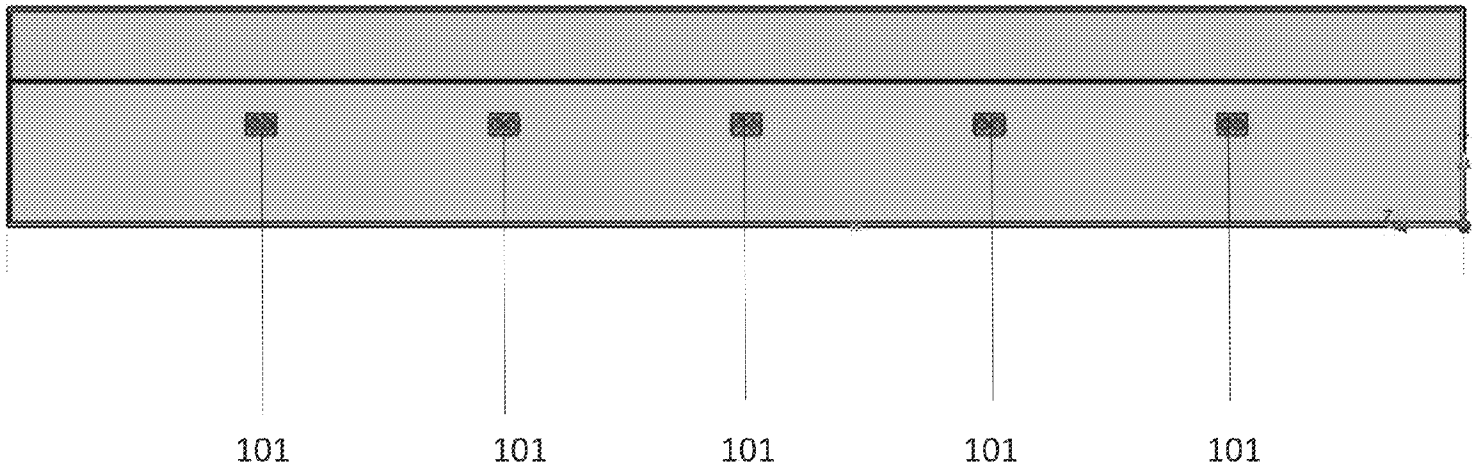
FIG. 2 is a side view of one embodiment of the present invention, illustrating a system for creating substantially continuous circulation within a volume to be managed. The system includes the one or more devices 101 that are operable for continuously drawing in, processing, and pushing out air through at least three exits.

FIG. 2 is a side view of one embodiment of the present invention, illustrating a system for creating substantially continuous circulation within a volume to be managed. The system includes the one or more devices that are operable for continuously drawing in, processing, and pushing out air through at least three exits.

The method of the present invention includes continuously drawing air into at least one of one or more devices, continuously processing air in the at least one of the one or more devices, and continuously pushing air through the at least three exit zones in at least one of the one or more devices. The air pushed through the at least three exit zones in one device will intersect and/or join air pushed through the same device and/or any other devices. The air is then drawn into the one or more devices again. In this fashion, the air is continuously cycled throughout the volume to be managed. By continuously moving air in the volume of air to be managed, air stratification and air pockets are minimized or eliminated. Furthermore, temperature variations are minimized because of the continuous movement and mixing of air.

The one or more devices utilized in the present invention include at least three exit zones. By including at least three exit zones in the one or more device, the mixing of air within the volume of air to be managed is maximized. Air is pushed out of the one or more devices from at least three exit zones, which allows for the air to be mixed in many more different directions than in a device containing only one exit zone. Preferably, the three exit zones provide for air to flow substantially horizontally out of the device. This minimizes or eliminates air pockets that develop when only one exit zone is used.

Figure 3:
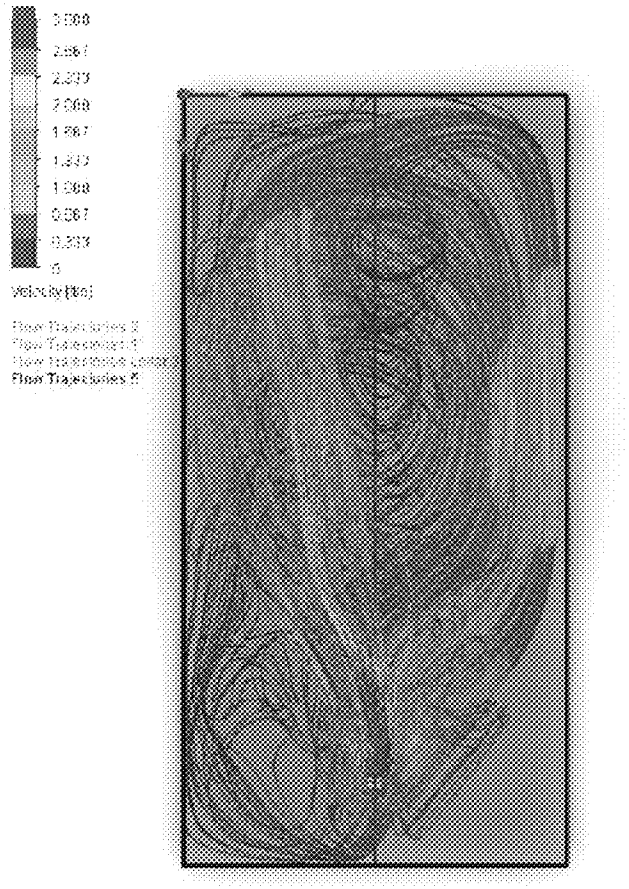
FIG. 3 shows a flow trajectory diagram of a simulation of flow trajectories coming from a single fan with a single exit zone after 30 minutes of the fan running in a 50'×200' building.

FIG. 3, particularly the bottom right corner and upper two corners, illustrates how air pockets form when only one exit zone is utilized in a device.

Figure 4:
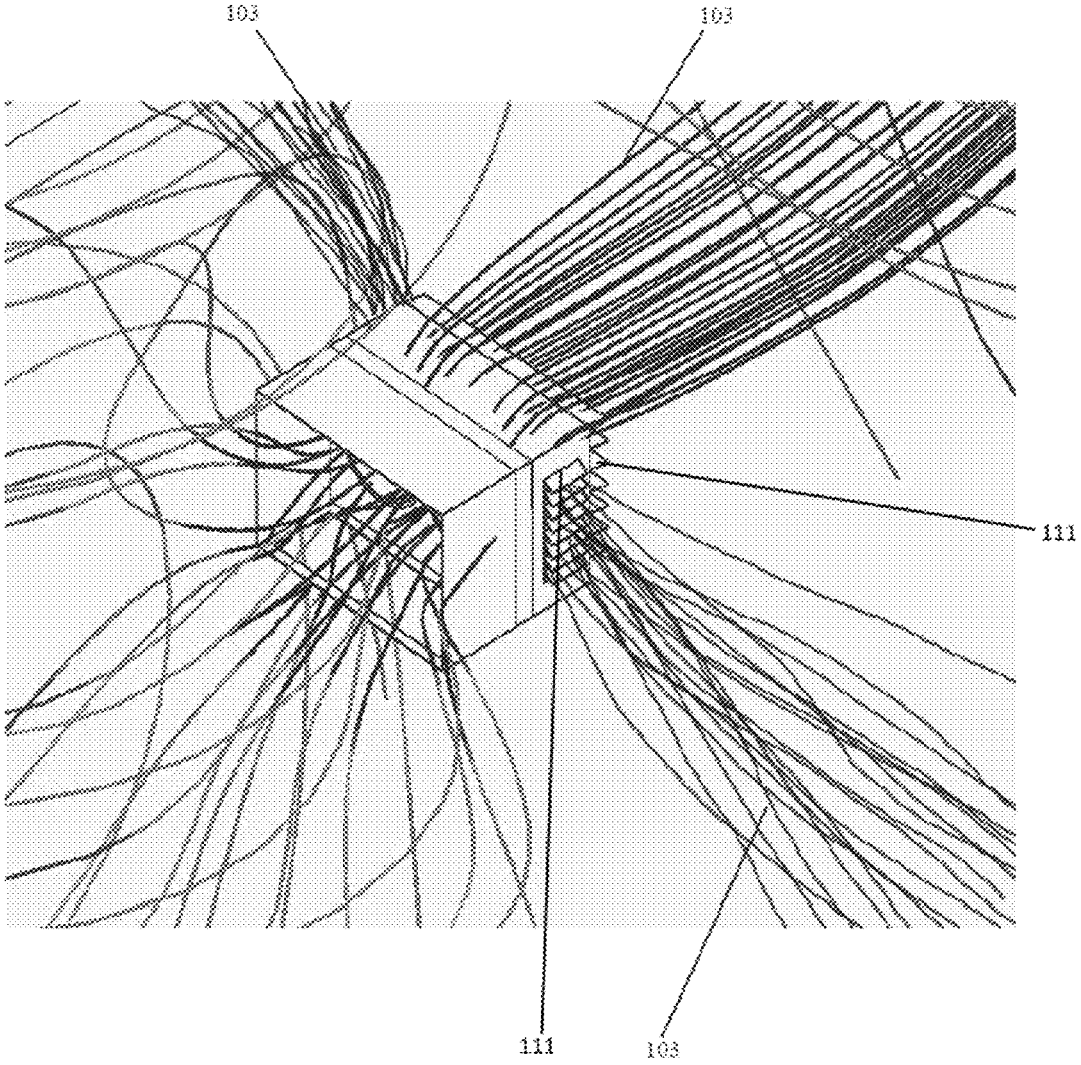
FIG. 4 illustrates the flow trajectories 103 of a device utilizing three exit zones.

On the other hand, FIG. 4 illustrates how air pockets are minimized or eliminated when three exit zones are utilized in the device. FIG. 4 illustrates at least three exit zones including louvers 111 and the air flowing out of the one or more devices through or over the louvers 111.

Figure 5:
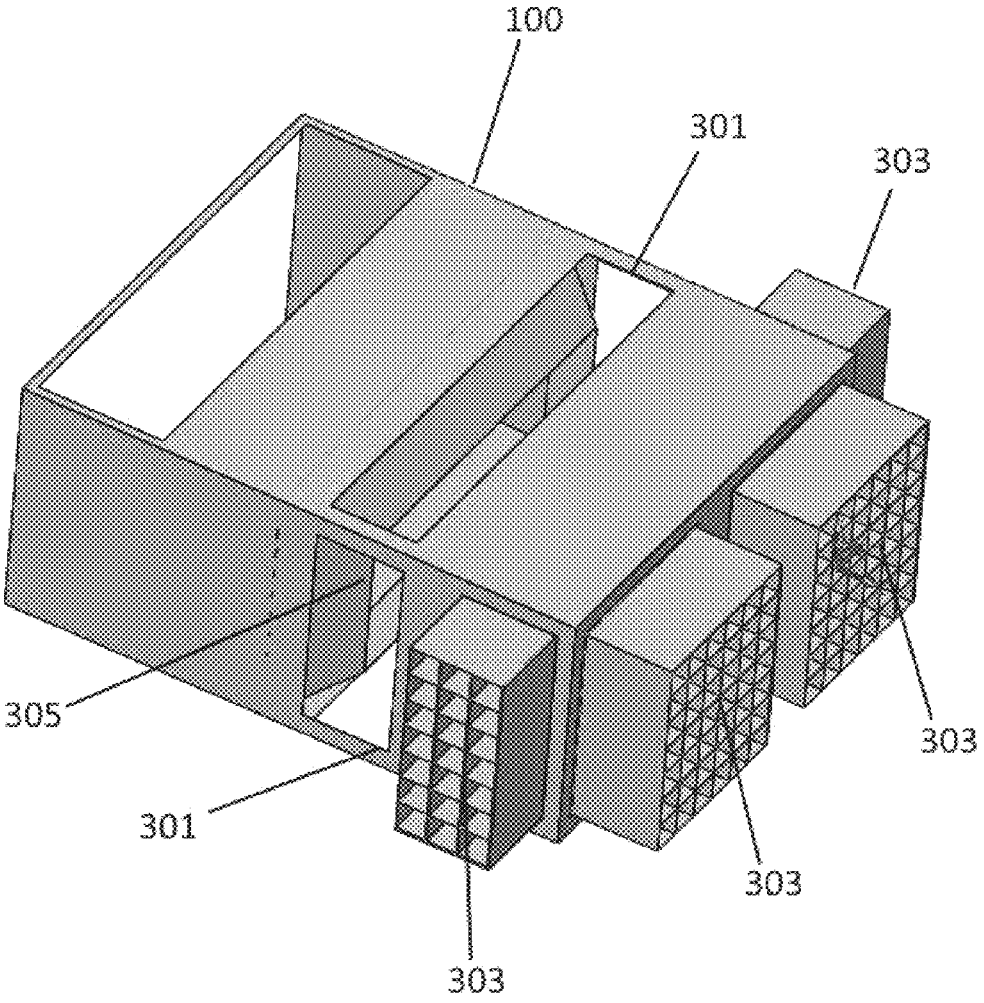
FIG. 5 is a perspective view of a device utilized in one embodiment of the present invention including a housing 100, air induction ports 301, lattices 303, and a nozzle 305.

FIG. 5 is a perspective view of a device utilized in one embodiment of the present invention including a housing 100, air induction ports 301, lattices 303, and a nozzle 305. The air induction ports draw air from outside of the unit to mix with the fan driven air. The air induction ports are in front of the fan blades. The air first passes over the blades, through the nozzle, through the air induction ports zone, over directional vanes, and then exits through the lattices. Preferably, the nozzle is constructed out of sheet metal. Notably, the nozzle increases the speed of air through the unit. In one embodiment, the nozzle increases the speed of air through the unit by about 10%. In another embodiment, multiple nozzles are utilized.

Another preferred embodiment of a device utilized in the present invention includes curved directional vanes between the air induction ports and the at least three exit zones for directing the air through the at least three exit zones with lattices. In yet another preferred embodiment of a device utilized in the present invention, the housing contains rounded corners and edges for increased airflow purposes.

Preferably, the one or more devices are controllable via a controller. Preferably, the controller is a remote controller. In one embodiment, the controller is a control panel.

Figure 6:
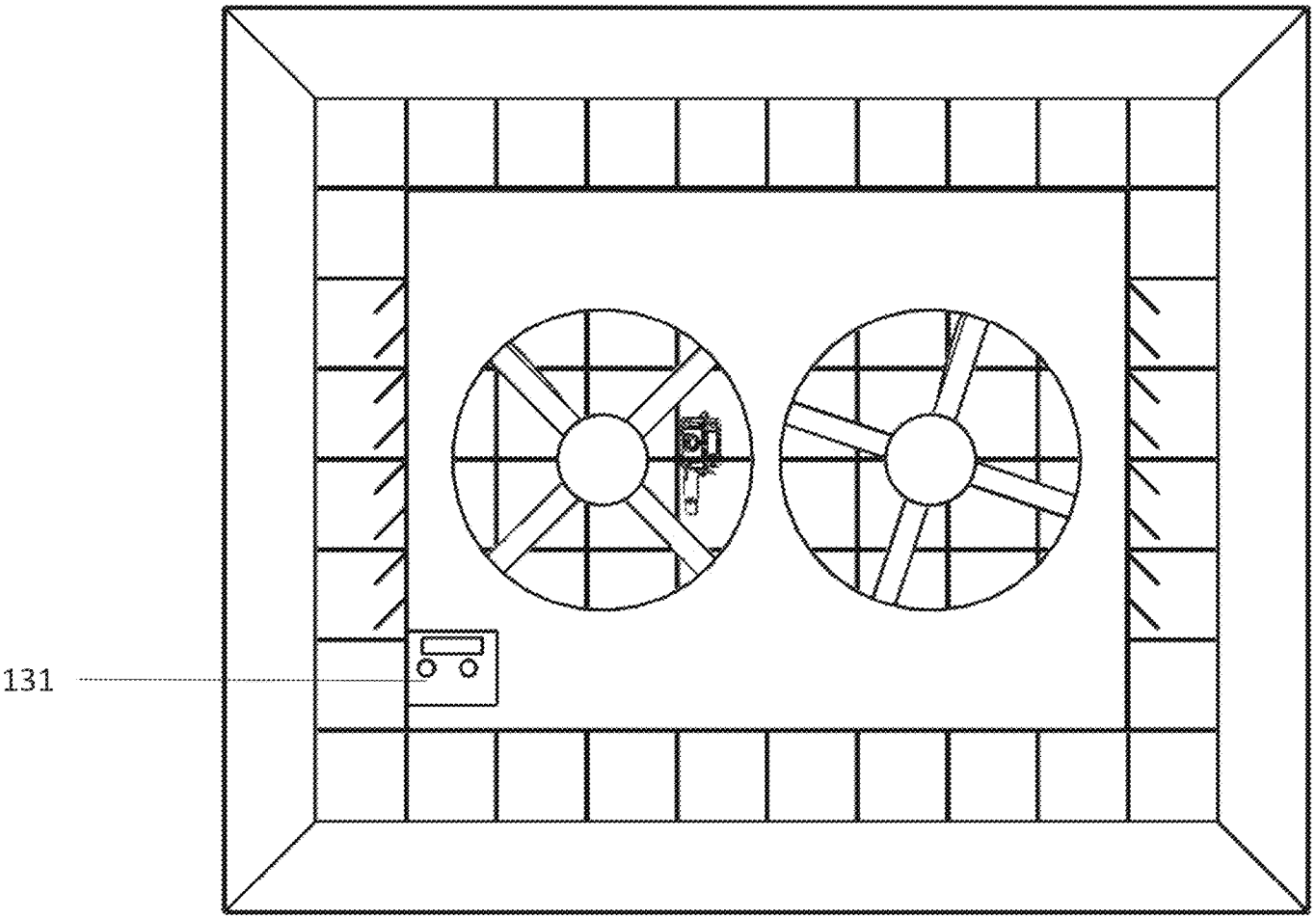
FIG. 6 shows a controller 131 operable for controlling the one or more devices.

FIG. 6 shows a controller 131 operable for controlling the one or more devices.

In another embodiment, the controller is mounted to the one or more devices. Preferably, the controller mounted to the one or more devices is constructed out of pre-painted color-Klad metal. The controller mounted to the one or more devices is also preferably mounted to the unit by bolts. Furthermore, the controller mounted to the one or more devices preferably includes a service switch mounted on the one or more devices, wherein the service switch is wired so that it communicates with at least one air transfer component and/or at least one power source or power supply. In one embodiment, the service switch is a 120/1 service switch. In one embodiment, the controller mounted to the device also contains a transformer. Preferably, the transformer is a 120/1 to 24 volt transformer. The controller mounted to the one or more devices preferably also contains a motor fuse to protect the motor from over-load. In one embodiment, the fuse is 15 amps.

In another embodiment, the controller is operable for controlling a mount of the one or more devices. Preferably, the controller is operable for controlling the angle and position of the one or more devices by controlling the mount. In one embodiment, a user inputs control commands into the controller.

In another embodiment, the controller operates in conjunction with at least one profile. Preferably, the profile is set by a user. Alternatively, the profile is a default profile or a pre-set profile. Preferably, the profile contains a setting which specifies a minimum and maximum value for certain parameters. In one embodiment, the parameter is temperature. In another embodiment, the parameter is humidity. In a further embodiment, the parameter is air flow. In one embodiment, the profile specifies a maximum allowable change in temperature, air flow, and/or humidity from a predefined temperature, air flow, and/or humidity value. A profile determines the performance of the steps of continuously drawing air into the one or more devices, continuously processing air in the one or more devices, and/or continuously pushing air through at least three exit zones in one or more devices are performed according to a profile in one embodiment of the present invention.

Preferably, the controller operates in conjunction with at least one profile by communicating with at least one sensor.

Figure 7:
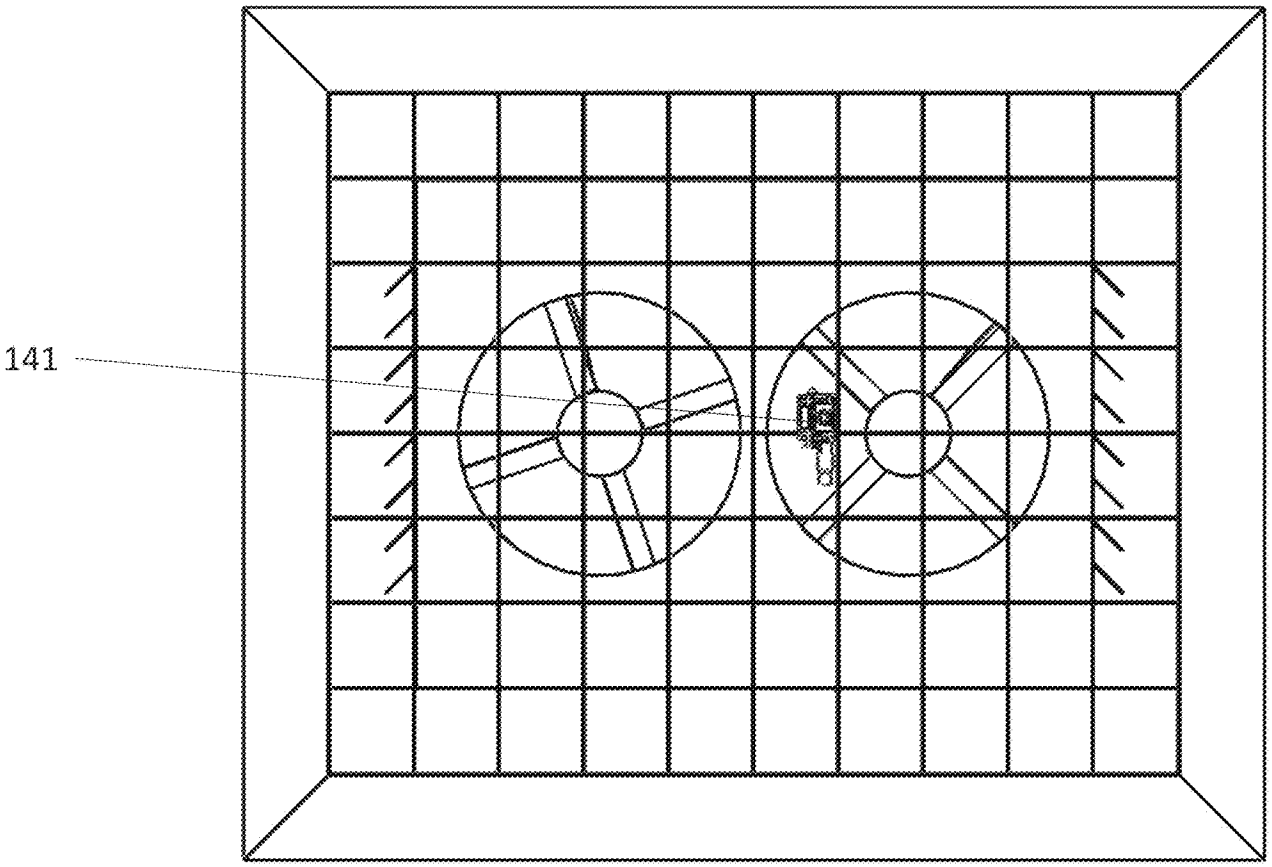
FIG. 7 shows a sensor 141 operable to communicate with the controller operable for controlling the one or more devices.

FIG. 7 shows a sensor 141 operable to communicate with the controller to control the functioning of the one or more devices.

In one embodiment, the at least one sensor is at least one temperature sensor which communicates with the controller to control the functioning of the one or more devices. Preferably, the method includes comparing a current temperature to a desired temperature or desired temperature range. If the current temperature is not equal to the desired temperature or not within the desired temperature range, then one or more of a variety of variables is adjusted. Preferably, the current temperature is measured using the at least one temperature sensor. Preferably, the at least one temperature sensor is a programmable thermostat. The programmable thermostat is a thermostat where a desired temperature or range of temperatures is selected. In one embodiment, the programmable thermostat is a 7 day 24 hour programmable thermostat. The programmable thermostat is preferably a 24 volt programmable thermostat.

In another embodiment, the at least one sensor is at least one humidity sensor which communicates with the controller to control the functioning of the one or more devices. A humidity regulator is included in at least one of the one or more devices in one embodiment of the present invention. Colder air is generally less humid than warmer air. Thus, colder air may need to be humidified to maintain the desired humidity. However, colder air may need to be dehumidified to maintain the desired humidity as well. Similarly, warmer air is generally more humid than colder air. Thus, warmer air may need to be dehumidified to maintain the desired humidity. However, warmer air may need to be humidified to maintain the desired humidity as well. Preferably, a current humidity within the facility is compared to a desired humidity or desired humidity range within the facility. If the current humidity is not equal to the desired humidity or not within the desired humidity range, then one or more variables is adjusted, or the humidity regulator adjusts the humidity.

In another embodiment, at least one sensor is an air flow sensor which communicates with the controller to control the functioning of one or more devices. Preferably, a current air flow within the facility is compared to a desired air flow or desired air flow range within the facility. In one embodiment, the air flow sensor measures the speed and/or direction of the air flow. If the current air flow is not equal to the desired air flow or not within the desired air flow range, then one or more variables is adjusted.

In yet another embodiment of the present invention, the method includes determining that the volume to be managed has changed. In one embodiment, determining that the volume to be managed has changed involves a user identifying a new volume to be managed or approximate new volume to be managed. Preferably, the user inputs this information into the controller which will adjust for the change in volume to be managed. Alternatively, the user adjusts one or more variables to account for the change in volume to be managed. If the volume to be managed has changed, one or more variables is preferably adjusted to account for the change in the volume to be managed.

In one embodiment, the variables that are adjusted to obtain a desired temperature or desired air flow include at least one of the speed of the air that is drawn into the one or more devices, the speed of air that is pushed out of the one or more devices, the direction of air that is drawn into the one or more devices, the direction of air that is pushed out of the one or more devices, the location of the one or more devices, the angle of the air that is pushed out of the one or more devices, the angle of air that is drawn into the one or more devices, the volume of the air that is pushed out of the one or more devices, and the volume of air that is drawn into the one or more devices. Preferably the variables that are adjusted are adjusted by controlling one or more devices. The one or more devices are preferably controlled using the controller.

Preferably, the speed of air that is pushed out of the one or more devices is adjusted by adjusting the air transfer component and/or at least one of the at least three exit zones of the one or more devices. In the preferred embodiments of the device, this preferably includes adjusting the louvers of the device.

Preferably, the location is adjusted using a mount. The mount preferably allows for rotation, vertical movement, and horizontal movement of the one or more devices. The one or more devices are preferably mounted to a ceiling, floor, or wall. In one embodiment, the mount is also angled. It is advantageous to be able to adjust the angle and position of the one or more devices to account for the characteristics of the volume of air to be managed. Also, the characteristics of the volume of air to be managed may change over time, and it is preferable to be able to change the angle and position of the one or more devices to account for those changes in the volume of air to be managed. In one embodiment, the mount is permanently affixed to the one or more devices. However, in another embodiment, the one or more devices are detachable from the mount. In a further embodiment, the mount fits onto a track affixed to a ceiling, and is movable on that track. Preferably, the mount contains arms and adjustment assemblies for adjusting the angle and position of the housing, air transfer component, or one or more devices generally. In one embodiment, the mount is adjustable via the controller which allows the user of the controller to swivel, angle, or reposition the one or more devices. One example of a preferred mount is a vibration-resistant free floating mount. This mount can be mounted at nearly any angle and can be adapted for beams of various sizes and construction. Preferably, the mount is finished with a material such as epoxy to reduce friction and dust buildup.

The direction of air that is pushed out of the one or more devices is preferably adjusted by adjusting at least one of at least three exit zones to the one or more devices. In the preferred embodiments of the device, the louvers are adjusted to adjust the direction of air that is pushed out of the device. In another embodiment, the direction of air that is pushed out of the one or more devices is adjusted by adjusting the location of the one or more devices. Preferably, the location is adjusted using the mount described above.

Preferably, the angle of the air that is pushed out of the one or more devices is adjusted by adjusting at least one of the at least three exit zones to the one or more devices. In the preferred embodiments of the device, the louvers are adjusted to adjust the direction of air that is pushed out of the device. In another embodiment, the direction of air that is pushed out of the more devices is adjusted by adjusting the location of the one or more devices. Preferably, the location is adjusted using the mount described above.

Preferably, the volume of the air that is pushed out of the one or more devices is adjusted by adjusting at least one of the at least three exit zones to the device. In the preferred embodiment of the device, the louvers are adjusted to adjust the volume of air that is pushed out of the device. In another embodiment, the speed of the fan is adjusted to adjust the volume of air that is pushed out of the device.

In one embodiment, the step of continuously drawing air into at least one of the one or more devices includes drawing air over at least one louver. Preferably, the louvers are curved directional louvers. In another embodiment, the louvers are dimpled to aid air flow through the device while decreasing the noise levels of the device. In one embodiment, the entrance of the device includes louvers and air flows into the device through the louvers. The louvers direct air flow into the device, and the louvers are selectively adjustable in partially open positions that modify the angle of air direction entering the device to change the air mixing within the air volume to be managed. The louvers are adjustable to the closed position to reduce or eliminate air coming into the device. The louvers also ideally protect the other components of the device while allowing air to flow into or out of the device. The louvers also protect living beings and inanimate objects from the other components of the device. By way of illustration, the louver sizes of 32"×5", 12"×5", 34"×5", 42"×5", 19"×5", and 46"×5" are suitable for use in the device. In another embodiment, the louvers are finished with a material such as epoxy to reduce friction and dust buildup.

In one embodiment, the step of continuously processing air in at least one of the one or more devices includes sanitizing the air. Preferably, sanitizing the air is performed by using a sanitation component. In one embodiment, the sanitation component is a film on the blades of the fans which prevents particulates from touching or adhering to the blades. In another embodiment, the sanitation component is a purifier which filters undesirable particles from the air. Such undesirable particles could include oil, dust, germs, or other particulates. Alternatively, sanitizing the air is performed by the Venturi effect In yet another embodiment, the step of continuously processing air in at least one of the one or more devices further includes at least one directional vane processing air in the at least one of the one or more devices. The at least one directional vane is operable for creating a more cohesive air flow exiting the device by guiding air in directions which achieve this effect. Furthermore, the at least one directional vane is operable for creating more directional outputs or strengthening the existing directional outputs of the device by guiding air in directions which achieve this effect. In one embodiment, the at least one directional vane is positioned between at least one air transfer component of the device and the at least three exit zones through which air exits the device. The at least one directional vane is adjustable among various directional positions in a preferred embodiment. In another embodiment, the at least one directional vane is curved to facilitate air flow over and around the at least one directional vane. In another embodiment, the directional vane is finished with a material such as epoxy to reduce friction and dust buildup. In yet another embodiment, the directional vanes are able to be rotated. Preferably, the controller is able to control the rotation of the directional vanes.

In another embodiment, the step of continuously processing air in at least one of the one or more devices further includes heating the air. In one embodiment, the device also includes a heater. Any type or make of a unit heater or HVAC unit (package or split) is a suitable heater for heating the facility. In one embodiment, the heater includes a frame. In one embodiment, the heater includes a frame. In a further embodiment, the frame is finished with a material such as epoxy to reduce friction and dust buildup. Preferably, the frame is a primed and painted 3/16" welded angle iron frame. In a further embodiment, the frame of the heater has holes punched in the frame. The heater preferably also include vibration isolators. In one embodiment, the vibration isolators are mounted between the heater and the frame.

Figure 8:
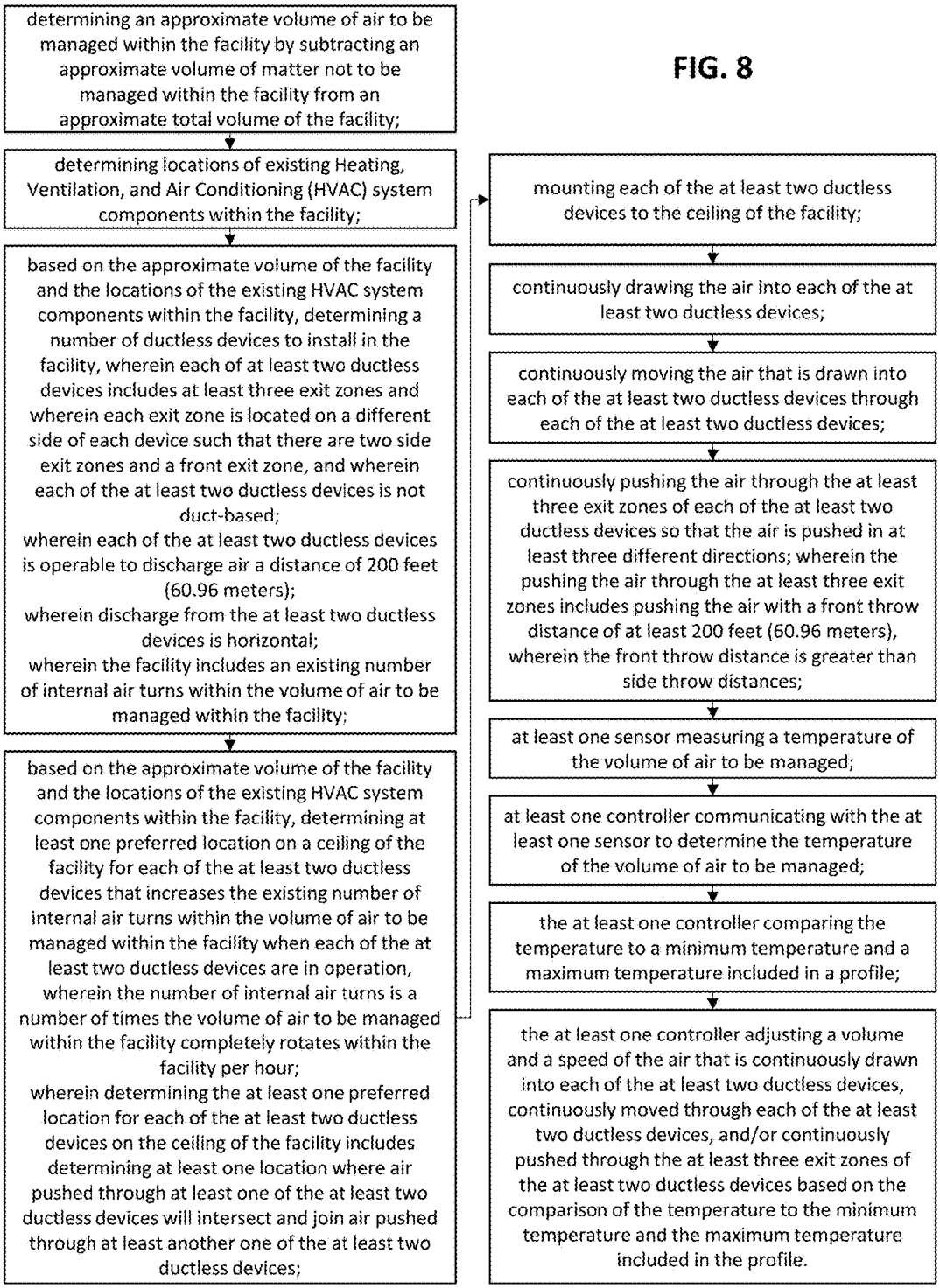
FIG. 8 illustrates a flow diagram of a method for increasing internal air turns in a volume of air to be managed within a facility and creating substantially continuous circulation within the facility according one embodiment of the present invention.

FIG. 8 illustrates a flow diagram of a method for increasing internal air turns in a volume of air to be managed within a facility and creating substantially continuous circulation within the facility according one embodiment of the present invention.

In another embodiment, the step of continuously processing air in at least one of the one or more devices further includes cooling the air. Preferably, cooling the air is performed by a cooling unit. The cooling unit preferably includes a housing. One preferred housing is constructed of 20 gauge pre-painted Sierra Color-Klad metal with PVC protective coating. The PVC protective coating prevents scratching during installation. In one embodiment, the housing for the cooling unit has an inlet. One preferred location for the inlet is on the top of the housing. A preferred size for the inlet is 48"×20". In one embodiment, the cooling unit includes a back panel for isolating discharged air. A preferred size for the back panel is 36"×22". A preferred material for the back panel is 20 gauge pre-painted Sierra Color-Klad metal with PVC protective coating, where the PVC protective coating is operable for preventing scratching during installation. In one embodiment, the cooling panel also includes a deflector panel for deflecting air. A preferred composition for the deflector panel is 20 gauge pre-painted Sierra Color-Klad metal with PVC protective coating, where the PVC coating prevents scratching during installation.

In another embodiment, the step of continuously pushing air through at least three exit zones in at least one of the one or more devices further includes pushing air over at least one louver. Preferably, the louvers are curved directional louvers. In another embodiment, the louvers are dimpled to aid air flow through the device while decreasing the noise levels of the device. Preferably, the at least three exit zones include louvers and air flows out of the one or more devices through the louvers. The louvers direct air flow out of the one or more devices, and the louvers are selectively adjustable in partially open positions that modify the angle of air direction exiting the one or more devices to change the air mixing within the air volume to be managed. The louvers are adjustable to the closed position to reduce or eliminate air coming out of the one or more devices. The louvers also ideally protect the other components of the one or more devices while allowing air to flow into or out of the one or more devices. The louvers also protect living beings and inanimate objects from the other components of the one or more devices. By way of illustration, the louver sizes of 32"×5", 12"×5", 34"×5", 42"×5", 19"×5", and 46"×5" are suitable for use in the one or more devices. In another embodiment, the louvers are finished with a material such as epoxy to reduce friction and dust buildup.

In yet another embodiment, the step of continuously pushing air through at least three exit zones in at least one of the one or more devices further includes pushing air through at least one lattice. Preferably, at least one exit zone to the one or more devices include at least one lattice for directing air through at least one of the at least three exit zones of the one or more devices. Among other things, the lattice is operable for improving the cohesion of the airstream(s) from the one or more devices. Preferably, the lattice is uniform, meaning it is made of equally spaced pockets. In one embodiment, the uniform lattice is made of repeating squares. In another embodiment, the uniform lattice is made of rectangles. In another embodiment, the uniform lattice is made of circles. In yet another embodiment, the uniform lattice is made of pentagons. In a further embodiment, the uniform lattice is made of hexagons, or a honey combed lattice. In another embodiment, the uniform lattice is made of heptagons. In yet another embodiment, the uniform lattice is made of octagons. Alternatively, the lattice is made of unequally spaced pockets. In one embodiment, the lattice is angled. In another embodiment, the lattice is tapered. In yet another embodiment, the lattice is finished with a material such as epoxy to reduce friction and dust buildup. The lattice is not a filter, but rather directs air flow.

In another embodiment, the method includes detecting a failure related to the steps of continuously drawing air into at least one of the one or more devices, continuously processing air in at least one of the one or more devices, and/or continuously pushing air through at least three exit zones in at least one of the one or more devices. Preferably, the failure is then remedied.

Another embodiment of the present invention includes a method for designing a system for creating substantially continuous circulation of a volume of air to be managed within a facility using one or more devices that are neither HVAC-based nor duct-based which continuously push air through at least three exit zones in at least one of the one or more devices so that the air pushed through the at least three exit zones is pushed in at least three different directions. The method includes determining the approximate volume of the facility; determining the location of any HVAC system components within the facility; and based on the approximate volume of the facility and the location of the HVAC system components within the facility, determining the number and type of the one or more devices to install in the facility and a preferred location for the one or more devices within the facility to achieve substantially continuous circulation within the volume of air to be managed. In one embodiment, the method for designing the system includes deploying air movement devices at a ratio of approximately 0.00006 to 0.00009 hp per square foot. Cubic feet per minute (CFM) from each air movement device is preferably a minimum of 19,000 CFM per 10,000 square feet. One embodiment of designing the system includes deploying air movement devices as close to the perimeter of the facility as feasible. Another embodiment includes deploying one air movement device for each 200 foot by 100 foot pattern. In yet another embodiment, the "primary throw" of the air movement device includes the wall opposite to the closest wall where the air movement device is located. In another embodiment, the air movement device has multiple significant "throws." Preferably, the throws are towards at least some or all of the other walls other than the wall or walls to which the air movement device is closest. In another embodiment, the primary air throw or significant throws are horizontal as opposed to down drafts. One embodiment provides for the primary air throw or significant air throws to align with product racks or other obstacles within the facility. The design of the system preferably eliminates the need for any diffuser system within the facility.

Preferably, the present systems and methods provide for optimizing HVAC tons to heat and cool the facility yielding a ton requirement about 20% to about 40% lower than conventionally recognized or calculated tons while increasing the horse power required to do so by no more than about 2.25 hp per about 20,000 square feet. In another embodiment, the present invention provides about a 60% lower tonnage requirement that conventional systems while increasing the horse power required to do so by no more than about 2.25 hp per 20,000 square feet. During the cooling season, the design of the systems and methods will preferably not allow for humid or hot air to accumulate near the ceiling. There is therefore less latent and sensible heat to remove by an HVAC system. During the heating season, a design will preferably maintain consistent temperature by utilizing all of the interior loads in conjunction with RTU and heat sources thus optimizing the efficiency of heating solution.

In one embodiment, the facility has at least a 20 foot ceiling with an open ceiling to roof deck, a 20' clear drop ceiling, rooftop mounted equipment without a ducted supply/return system, is at least 20,000 square feet, and has 0.5 CFM/square foot outside air. However, the methods of the present invention are operable to work in a variety of facilities with varying ceiling heights and areas.

In one embodiment, a baseline is set at 1100 SF/ton at 78 degrees Fahrenheit/95 degrees Fahrenheit (17 degrees Fahrenheit change in temperature). A straight line is used for the difference in temperature vs SF/ton, i.e. if the design change in temperature changes to 23 degrees Fahrenheit, the difference would be 23/17×tons to get the new tonnage. Generally, 6 air changers are used in lieu of air conditioning. Exhaust fans can affect the load if used, as the exhaust fans affect equilibrium. In this embodiment, it is assumed that R-19 insulation is used on the roof. If the insulation is less, it will affect the load, particularly in older buildings. Infiltration is included and is minimum. Lighting is 1 kw/SF—if different, it will affect the load in tons. People load is assumed to be minimal. Circulation for a 38 foot high ceiling is 2 air turns per hour. Circulation for a 25 foot high ceiling is 3 air turns per hour. Note that conventional job will run 50% less.

In one embodiment where the facility is a distribution center of 1100 SF/ton at 78 degrees Fahrenheit/95 degrees Fahrenheit, the center has an area of 110,000 SF, and the ceiling height is 30 feet, the calculation for tons would be 110,000 SF/1100 SF/ton=100 tons. Two preferred devices of the present invention are a 18,000 CFM device and a 32,000 CFM device. A formula for determining the air turns per hour is: CFM/vol. cu. ft.×60 min/hr=air turns per hour. With a goal of approximately 3 air turns per hour and using 4 18,000 CFM devices, there would be a total of 72,000 CFM. Using the formula produces 72,000 CFM/(110,000 SF×30 feet)×60 min/hr=1.3 air turns/hr. Using 4 32,000 CFM devices would yield 4×32,000 CFM=128,000 CFM. Using the formula with the 4 32,000 CFM devices produces 128,000 CFM/(110,000 SF×30 feet)×60 min/hr=2.56 air turns/hr. Therefore, in one embodiment 4 25 ton RTU w/ 4 32,000 CFM devices would be utilized because both tonnage and CFM is met giving 2.56 air turns per hour vs. 3.0 air turns per hour. It should be noted that tonnage could change with a change in temperature (either up or down), internal load could change the load if large, if lighting varies vs 1 kw/SF it will affect the load in tons, and people load increasing could also vary the tonnage.

In another embodiment, the facility is a retail center (ex: Home Depot, Sam's, Costco, Lowes, etc.) with a 25 foot ceiling, open ceiling to roof deck, rooftop maintained equipment without a ducted system/return system, 7000 SF, 0.12 CFM/SF, assuming 7.5 CFM per person of outside air. If the people load is different than the values may change. With a base line at 550 SF/ton at 78 degrees Fahrenheit/95 degrees Fahrenheit, a change in temperature of 17 degrees Fahrenheit, with a 550 SF/ton, use a straight line for the difference in temperature vs. SF/ton, i.e. if design change in temperature changes then new change in temperature/old change in temperature×tons=new tons. People load is assumed to be 15/1000 SF unless actual people are known. Lighting load design up to 1.5 kw/hr. Outdoor air requirement is 0.12 CFM/SF plus 7.5 CFM per person. R-19 is assumed to be used on the roof—if it is a lower R factor, it could affect the load. Infiltration in retail could be less than in the distribution center depending on door opening and the time the door is left open 0.20 AC/hr. With a 25 foot HT ceiling 3 air turns per hour is desired.

For a retail application with 550 SF/ton at 78 degrees Fahrenheit/95 degrees Fahrenheit, a size of 94,000 SF, a ceiling height of 28 feet, and needing close to 3 air turns per hour, the tonnage required with one or more devices is 94,000 SF divided by 550 SF/ton=170 tons. Note that if any of the values above are different, the tonnage would be adjusted. With an air turn per hour/60×vol=CFM, 3/60×94,000 SF×28=131,600 CFM. Using 24 ton and 20 ton units the number of devices needs to be determined. It should be noted that if 131,600 CFM is needed and 4 32,000 CFM devices are used, the needed CFM is covered with 4 devices at 32,000 CFM for 128,000 CFM but tonnage will be short with 4 AC units. If 18,000 CFM devices at 131,600 CFM, the number of devices is calculated by dividing 131,600 CFM by 18,000 CFM to get 7.31 devices needed. In one embodiment in a retail facility, like units are replaced with like A/C units. Five 24 ton A/C units=120 tons and 3 20 ton A/C units=60 tons, giving a total of 180 tons. Each A/C unit gets 1-18,000 CFM device unit. Seven devices (device with package RT 20 ton) are enough to create the desired amount of air turns in one embodiment. It can be determined if an $8^{th}$ device is needed by setting the stat for the $8^{th}$ device higher than the other 7 devices. The facility can then use their control system to determine if the $8^{th}$ device is ever needed.

In one embodiment for retail facilities, divide the SF of the building and divide by 550 SF/ton to determine the tonnage. Tonnage can then be adjusted for: change in temperature design different than 17 degrees Fahrenheit (straight increase or decrease), adjust for outside air change above 0.12 CFM/SF and 7.5 CFM/person, adjust tonnage for lighting above 1.5 kW/SF, adjust if people load is different than 15 people/1000 SF, and adjust load if roof insulation is less than R-19.

Preferably, the approximate volume of the facility is determined by determining the approximate dimensions of the facility. The approximate dimensions of the facility are preferably determined by conventional methods, such as measuring the dimensions. The approximate dimensions of the facility alternatively are determined by consulting a blueprint, floor plan, or any other document containing approximate dimensions of the facility.

Determining the location of any HVAC system components is preferably performed by consulting a blueprint, floor plan, or any other document containing the location of HVAC system components. Alternatively, determining the location of any HVAC system component is performed by observation.

Based on the approximate volume of the facility and the location of the HVAC system components within the facility, the number and type of the one or more devices to install in the facility are determined. Generally, the larger the facility, the more devices are installed. Also, the larger the facility, the more high-powered devices are installed.

In a further embodiment, the method for designing the system for creating substantially continuous circulation of a volume of air to be managed within a facility includes the step of determining an approximate volume or actual volume of the air to be managed within the facility. This step is preferably performed by subtracting the approximate or actual volume of matter (machinery, objects, goods, etc.) within the facility from the approximate or actual volume of the facility. This calculation yields the actual or approximate volume of air to be managed within the facility. Based on the actual or approximate volume of air to be managed within the facility, the number and type of one or more devices to install in the facility is determined. Additionally, based on the location of the matter within the facility, a preferred location for the one or more devices within the facility is determined.

In another embodiment, the method for designing the system for creating substantially continuous circulation of a volume of air to be managed within a facility includes the step of determining the location of any windows and/or doors in the facility. This step is preferably performed by physical observation and measurement. Alternatively, this step is performed by consulting a blueprint, floor plan, or any other document containing the location of any windows and/or doors in the facility. Based on the location of any windows and doors and the number and type of devices to install in the facility, a preferred location for the one or more devices within the facility is determined.

In another embodiment, the method includes the step of determining a preferred location for at least one sensor within the facility. Preferably, this step is based on the preferred location for the one or more devices, any windows and/or doors, and any HVAC system components within the facility. The at least one sensor preferably measures a property of the environment of the facility. Preferably, the property of the environment of the facility is at least one of temperature, air flow, and humidity. Preferably, the at least one sensor is at least one of the temperature sensor, the air flow sensor, and the humidity sensor.

In yet another embodiment, the method includes determining the location of internal loads within the facility, and based on the location of the internal loads within the facility, determining at least one preferred location for the at least one sensor and/or the one or more devices. Internal loads include machinery, equipment, lighting, and/or any other heat producing objects.

In another embodiment of the present invention, the invention includes a system for creating substantially continuous circulation within a volume to be managed. The system includes one or more devices that are neither HVAC-based nor duct-based, wherein air is continuously drawn into at least one of the one or more devices, continuously processed by at least one of the one or more devices, and continuously pushed through at least three exit zones in at least one of the one or more devices so that the air pushed through the at least three exit zones is pushed in at least three different directions. The air that is pushed in at least three different directions is mixed with itself and other air, which consequentially achieves substantially continuous circulation within the volume to be managed.

In another embodiment of the present invention, the system includes a sensor and a controller. The sensor measures at least one of a temperature, humidity, and air flow, and in response to the sensor measuring at least one of the temperature, humidity, and air flow, the controller adjusts the location of at least one of the one or more devices and/or at least one of the volume, speed, direction, and angle of air that is continuously drawn into at least one of the one or more devices, continuously processed by at least one of the one or more devices, and/or continuously pushed through at least three exit zones in at least one of the one or more devices.

In yet another embodiment of the present invention, the system further includes a profile including a minimum and/or maximum temperature, minimum and/or maximum humidity, and/or minimum and/or maximum airflow. The sensor compares at least one of the measured temperature, humidity, and air flow to the minimum and/or maximum temperature, humidity, and/or airflow, and in response to the comparison, the controller adjusts the location of at least one of the one or more devices and/or at least one of the volume, speed, direction, and angle of air that is continuously drawn into at least one of the one or more devices, continuously processed by at least one of the one or more devices, and/or continuously pushed through at least three exit zones in at least one of the one or more devices.

Other embodiments of the one or more devices utilized in the present invention are described below, and are provided by way of example and not limitation.

In one embodiment the air transfer component of the device is at least one fan. The at least one fan is preferably made of blades joined together by a hub or any other means. The device preferably contains a hub keyed to a fan shaft. In one embodiment, the hub is a typical hub used in the prior art, such as a 10-blade one-piece cast aluminum hub. However, preferably the hub is the new 6-blade hybrid hub. In one embodiment, the hub is finished with a material such as epoxy to reduce friction and dust buildup. In one embodiment, the fan is 30", ½ hp, and 115/1-12 amps. In another embodiment, the fan is 42", ¾ hp, and 115/1-14 amps. The noise level from the 30" and 42" fans does not exceed 12 sones or 64 dba. Alternatively, the fan is a Dyson fan.

The blades of the fan preferably operate as both discharge blades and intake blades. Alternatively, the blades of the fan are specifically either discharge blades or intake blades. In one embodiment, the blades are 4-way 20 gauge 360 degree blades. The blades of the fan are preferably made of galvanized G90 steel minimum 16 gauge. The blades are preferably epoxy coated. The blades should be anchored with insert nuts and bolts to eliminate loosening. The insert nuts and bolts are preferably nylon. In a preferred embodiment, the insert nuts and bolts are ¼ inch. In another embodiment, the insert nuts and bolts and blades of the fan are finished with a material such as epoxy to reduce friction and dust buildup.

In one embodiment, the blades of the fan contain tubercles on the leading edge to increase performance. In a further embodiment, the tubercles are incorporated into the blade. In another embodiment, the tubercles are attached to the blade. The tubercles are preferably made out of the same material as the blade. Tubercles have the effect of channeling air into smaller areas of the blade, resulting in a higher speed through the channels. Furthermore, the tubercles eliminate the tendency of air to run down the length of the blade's edge and fly off at the tip, which causes noise, instability, and decreased efficiency. Examples of blades with tubercles are illustrated in U.S. Pat. No. 8,535,008 for "Turbine and compressor employing tubercle leading edge rotor design" by Dewar, et al., filed on Oct. 18, 2005 and issued on Sep. 17, 2013, which is incorporated herein by reference in its entirety.

In another embodiment, the blades of the fan are slotted to increase performance. Specifically, slotted blades help increase power generation and therefore increase the throw distance of the device compared to traditional blades. The air throw of prior art devices is limited to about 50 feet. However, the air throw of the devices of the present invention is preferably at least about 100 feet. In another embodiment, the air throw of the devices of the present invention is preferably about 150 feet. In another embodiment, the air throw of the devices of the present invention is preferably about 200 feet. However, it should be appreciated that the air throw of the devices of the present invention are adjustable anywhere from about 25 feet to about 200 feet.

In another embodiment, the blades of the fan contain winglets. In one embodiment, the winglets are incorporated into the blade. In another embodiment, the winglets are attached to the blade. The winglets are preferably made out of the same material as the blade. Examples of blades with winglets are illustrated in U.S. Pat. No. 6,776,578 for "Winglet-enhanced fan" by Belady, filed on Nov. 26, 2002 and issued on Aug. 17, 2004, which is incorporated herein by reference in its entirety.

The blades of the fan include dimples in another embodiment. When the blades of the fan rotate, the dimples generate turbulence that disturbs air deflection angles, causing the speed of air flow to increase and noise levels to decrease. Examples of blades with dimples are illustrated in U.S. Pub. No. 2006/0110257 for "Ceiling Fan Blade" by Huang, filed Nov. 23, 2004 and published May 25, 2006, which is incorporated herein by reference in its entirety.

In another embodiment, the at least one air transfer component includes at least two fans configured to rotate in opposite directions. This counter rotation produces a cohesive air flow from at least one of the at least three exit zones to the device when the fans are oriented in a parallel configuration. By producing a more cohesive air flow through the use of counter rotating fans, the device has a greater throw distance compared to a device with only one rotating fan. The greater throw distance maximizes the mixing of air within the volume of air to be managed. The counter rotating fans produce a much more cohesive flow trajectory with a greater throw distance than the single fan.

In one embodiment, the device includes guards. In a further embodiment, the guards are front guards. Preferably, the front guards are located near the at least three exit zones to the device. In another embodiment, the guards are back guards. Preferably, the back guards are located near the at least one entrance to the device. In one embodiment, the back guards are finished with a material such as epoxy to reduce friction and dust buildup. In yet another embodiment, the guard is a unit fan guard. The unit fan guard prevents airborne objects from being sucked into the device.

In one embodiment, the housing of the device includes side walls, a top, and a bottom. Ideally, the housing allows for air to exit the device from every direction to maximize the mixing of air within the volume of air to be managed. In one embodiment, the housing has edges and corners. In another embodiment, the housing has rounded edges and rounded corners. In a further embodiment, the housing has rounded sides. In one embodiment, the housing is cylindrical. In another embodiment, the housing is cubic. In a preferred embodiment, the housing is a rectangular prism. In another preferred embodiment, the housing is approximately a rectangular prism with rounded edges and rounded corners. In another embodiment, the housing is a pentagonal prism. In another embodiment, the housing is a hexagonal prism. In another embodiment, the housing is a heptagonal prism. In another embodiment, the housing is an octagonal prism. In another embodiment, the side walls of the housing are not uniform in length. Preferably, the housing is constructed of approximately 20 gauge pre-painted Sierra Color-Klad metal with PVC protective coating. The PVC protective coating is operative to prevent scratching during installation. In another embodiment, the housing is finished with a material such as epoxy to reduce friction and dust buildup. In another embodiment, the interior of the housing is dimpled to aid air flow through the device while decreasing the noise levels of the device. In another embodiment, the exterior of the housing is dimpled to aid air flow around the device.

In one embodiment, the corners and edges of the housing are roll formed. Alternatively, the corners and edges of the housing are pressed. In one embodiment, the edges and corners are screwed together with the flat sides of the housing. Alternatively, the edges and corners are glued together with the flat sides of the housing. In a further embodiment, a gasket is placed between the edges, corners, and/or flat sides of the housing to dampen sound.

In a further embodiment, the housing contains two or more air transfer components within the same housing to pull air into the device and push air out of the device.

In one embodiment, the device includes an air transfer component and a housing with a substantially open exit zone side which is at least 90% open, two partial exit zone sides which are at least about 50% open, an entrance side, and a top and bottom. Preferably the substantially open exit zone side and the two partial exit zone sides include louvers. The louvers also preferably extend to cover at least about 50% of the partial exit zone sides. The louvers are considered as part of the at least about 50% that is open in the two partial exit zone sides.

Having at least about 50% of the partial exit zone sides open allows for better mixing of the air within the air volume to be managed. Air enters the device through the entrance side and exits the device through the substantially open exit zone side and two partial exit zone sides. By having partial exit sides, air pockets in the volume of air to be managed are minimized or eliminated while the greater throw distance from the substantially open exit zone side is preserved. The louvers of the substantially open exit zone side and partially open exit zone sides are adjustable between the open and closed positions, and are selectively adjustable in partially open positions that modify the angle of air direction exiting the device to change the air mixing within the air volume to be managed.

In one embodiment, the device contains vibration isolators mounted between the at least one air transfer component and the at least one housing. The vibration isolators reduce the vibrations of the device, allowing for a quieter and more efficiently running device. In another embodiment, the vibration isolators are mounted between the at least one housing and frame. In a further embodiment, the vibration isolators are finished with a material such as epoxy to reduce friction and dust buildup.

In another embodiment, the device includes two adjacent housings, wherein each adjacent housing includes at least one air transfer component, at least one bottom entrance, at least three exit zones, and a side that is not one of the at least three exit zone sides or the at least one bottom entrance. The side of the first adjacent housing that is not one of the at least three exit zone sides or the at least one bottom entrance faces the side of the second adjacent housing that is not one of the at least three exit zone sides or the at least one bottom entrance. Air is pulled through the at least one bottom entrance and pushed by the air transfer component out the at least three exit zone sides of each housing.

The device preferably also include features designed to improve the safety of the operation of the device. Such features include failure detection and management, as well as detecting adverse conditions such as fires or undesired temperature differences.

In one embodiment, the device lacks a compressor.

In a further embodiment, the device includes a noise reduction component for dampening the sound made by the device.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A method for designing a system for increasing internal air turns in a volume of air to be managed within a facility and creating continuous circulation within the facility, wherein the method comprises the steps of:

determining an approximate volume of air to be managed within the facility by subtracting an approximate volume of matter not to be managed within the facility from an approximate total volume of the facility;

determining locations of existing Heating, Ventilation, and Air Conditioning (HVAC) system components within the facility;

based on the approximate volume of the facility and the locations of the existing HVAC system components within the facility, determining a number of ductless devices to install in the facility, wherein each of at least two ductless devices includes at least three exit zones and wherein each exit zone is located on a different side of each device such that there are two side exit zones and a front exit zone, and wherein each of the at least two ductless devices is not duct-based;

wherein each of the at least two ductless devices is operable to discharge air a distance of 200 feet;

wherein discharge from the at least two ductless devices is horizontal;

wherein the facility includes an existing number of internal air turns within the volume of air to be managed within the facility;

based on the approximate volume of the facility and the locations of the existing HVAC system components within the facility, determining at least one preferred location on a ceiling of the facility for each of the at least two ductless devices that increases the existing number of internal air turns within the volume of air to be managed within the facility when each of the at least two ductless devices are in operation, wherein the number of internal air turns is a number of times the volume of air to be managed within the facility completely rotates within the facility per hour;

wherein determining the at least one preferred location for each of the at least two ductless devices on the ceiling of the facility includes determining at least one location where air pushed through at least one of the at least two ductless devices will intersect and join air pushed through at least another one of the at least two ductless devices;

mounting each of the at least two ductless devices to the ceiling of the facility;

continuously drawing the air into each of the at least two ductless devices;

continuously moving the air that is drawn into each of the at least two ductless devices through each of the at least two ductless devices; and continuously pushing the air through the at least three exit zones of each of the at least two ductless devices so that the air is pushed in at least three different directions, wherein the pushing the air through the at least three exit zones includes pushing the air with a front throw distance of at least 200 feet, wherein the front throw distance is greater than side throw distances;

at least one sensor measuring a temperature of the volume of air to be managed;

at least one controller communicating with the at least one sensor to determine the temperature of the volume of air to be managed of the;

the at least one controller comparing the temperature to a minimum temperature and a maximum temperature included in a profile;

the at least one controller adjusting a volume and a speed of the air that is continuously drawn into each of the at least two ductless devices, continuously moved through each of the at least two ductless devices, and/or continuously pushed through the at least three exit zones of the at least two ductless devices based on the comparison of the temperature to the minimum temperature and the maximum temperature included in the profile.

2. The method of claim 1, further comprising the step of determining locations of internal loads, windows, and doors within the facility, wherein the step of determining the number of the at least two ductless devices to install in the facility and the at least one preferred location on the ceiling of the facility for each of the at least two ductless devices that increases the existing internal air turns within the volume of air to be managed is also based on the locations of the internal loads, the windows, and the doors within the facility, wherein the internal loads include machinery and lighting.

3. The method of claim 2, further comprising the steps of:

determining at least one preferred location for the at least one sensor within the facility based on the at least one preferred location on the ceiling of the facility for the at least two ductless devices, the locations of the internal loads, the windows, and the doors within the facility, the approximate volume of the facility, and the locations of the existing HVAC system components within the facility.

4. The method of claim 1, further comprising the step of estimating a reduction in tonnage utilized in the facility based on data for buildings using only HVAC systems compared to data for buildings using the method for designing the system for increasing internal air turns in the volume of air to be managed within the facility and creating continuous circulation within the facility, wherein the step of determining the number of ductless devices to install in the facility and the at least one preferred location on the ceiling of the facility for the at least two ductless devices that increases the internal air turns within the volume of air to be managed within the facility is also based on the estimated reduction in tonnage utilized in the facility.

5. The method of claim 1, wherein the number of internal air turns is a number of internal air turns per hour and is calculated by dividing a cubic feet per minute output of the at least two ductless devices by the approximate volume of the facility and multiplying the quotient by 60.

6. The method of claim 1, wherein the method does not require any HVAC diffusers.

7. The method of claim 1, wherein the existing HVAC system components include a package HVAC unit or a split HVAC unit, and wherein the method maintains an air temperature of the volume of air to be managed within the facility within 2 degrees Fahrenheit above or below a desired temperature of the volume of air to be managed.

8. The method of claim 1, wherein each of the at least two ductless devices includes a housing with a substantially open front exit zone side which is at least 90% open and two partial exit zone sides which are each at least 50% open.

9. The method of claim 1, wherein throw distances are adjusted based on an amount the at least three exit zones are open.

10. A system for increasing internal air turns and creating substantially continuous circulation within a volume to be managed comprising at least two ductless devices, wherein each of the at least two ductless devices includes at least three exit zones, the at least three exit zones being located on different device sides, and wherein each of the at least two ductless devices is not duct-based;

wherein the at least two ductless devices are operable to continuously draw air into the at least two ductless devices, continuously move the air that is drawn into the at least two ductless devices through the at least two ductless devices, and continuously push the air through the at least three exit zones of the at least two ductless devices, wherein each of the at least two ductless devices has a front discharge distance of at least 200 feet, wherein the front throw distance is greater than side throw distances;

wherein discharge from the at least two ductless devices is substantially horizontal;

wherein the air pushed through the at least three exit zones is pushed in at least three different directions and mixed with itself and facility air in the volume to be managed, thereby achieving substantially continuous circulation within the volume to be managed and increasing a number of internal air turns within the facility, wherein the number of internal air turns is a number of times the volume of air to be managed within the facility completely rotates within the facility per hour;

wherein the at least two ductless devices are positioned such that air pushed through at least one of the at least two ductless devices intersects and joins air pushed through at least another one of the at least two ductless devices; and wherein at least one of the at least two ductless devices includes at least two fans configured to rotate in opposite directions.

11. The system of claim 10, wherein a motor in each of the at least two ductless devices consists of a 3/4 horsepower motor.

12. The system of claim 10, wherein each of the at least two ductless devices includes a housing with a front exit zone side which is adjustable between 90% open and fully open and two partial exit zone sides which are adjustable between 50% open and fully open.

13. The system of claim 12, wherein each of the at least two ductless devices includes louvers operable to close the two partial exit zone sides.

14. The system of claim 13, further comprising wherein the louvers are curved.

15. The system of claim 10, wherein housing interiors of the at least two ductless devices are dimpled to aid air flow through the device.

16. The system of claim 10, further comprising dimpled fan blades.

17. A method for increasing internal air turns and creating substantially continuous circulation within a volume to be managed using at least two ductless devices comprising the steps of:

continuously drawing air into the at least two ductless devices;

continuously moving the air through the at least two ductless devices; and continuously pushing the air through at least three exit zones of each of the at least two ductless devices so that the air pushed through the at least three exit zones is pushed in at least three different directions, wherein each of the at least three exit zones is located on a different side of each of the at least two ductless devices, wherein each of the at least two ductless devices is not duct-based;

wherein the pushing the air through the at least three exit zones includes pushing the air with a front throw distance of at least 200 feet, wherein the front throw distance is greater than side throw distances;

wherein discharge from the at least two ductless devices exits through at least one horizontal exit zone of the at least two ductless devices;

wherein the steps of continuously drawing air into the at least two ductless devices, continuously moving the air through the at least two ductless devices, and continuously pushing the air through at least three exit zones of the at least two ductless devices are performed according to a profile;

wherein the air that is pushed in at least three different directions is mixed with itself and facility air in the volume to be managed, thereby increasing internal air turns within the volume to be managed, wherein the number of internal air turns is a number of times the volume to be managed within the facility completely rotates within the facility;

measuring a temperature within the volume to be managed;

adjusting at least one parameter of the at least two ductless devices that controls a volume, a speed, a direction, and an angle of the air continuously pushed through the at least three exit zones of the at least two ductless devices based on a comparison of the temperature to a desired minimum temperature and a desired maximum temperature.

18. The method of claim 17 wherein the step of continuously pushing the air through at least three exit zones of the at least two ductless devices includes gathering air through a rear air intake and side air induction ports.

19. The method of claim 17 further comprising detecting a failure related to the steps of continuously drawing air into the at least two ductless devices, continuously moving the air in the at least two ductless devices, or continuously pushing the air through the at least three exit zones of the at least two ductless devices.

20. The method of claim 17, further comprising the step of performing between two internal air turns per hour and three internal air turns per hour in the volume to be managed using the at least two ductless devices.

* * * * *